US011913221B2

(12) United States Patent
McGough et al.

(10) Patent No.: US 11,913,221 B2
(45) Date of Patent: Feb. 27, 2024

(54) SECURE VIDEO VISITATION BOOTH

(71) Applicant: TATE ACCESS FLOORS, INC., Jessup, MD (US)

(72) Inventors: Maxwell Edward McGough, Mansfield, TX (US); Jude Widmann, Lehi, UT (US); Gwen Demosky, Ellicott City, MD (US)

(73) Assignee: TATE ACCESS FLOORS, INC., Jessup, MD (US)

( * ) Notice: Subject to any disclaimer, the term of this patent is extended or adjusted under 35 U.S.C. 154(b) by 0 days.

(21) Appl. No.: 17/869,378

(22) Filed: Jul. 20, 2022

(65) Prior Publication Data

US 2024/0026677 A1 Jan. 25, 2024

(51) Int. Cl.
*E04B 1/82* (2006.01)
*E04H 1/12* (2006.01)

(52) U.S. Cl.
CPC ..... *E04B 1/8218* (2013.01); *E04H 1/125* (2013.01)

(58) Field of Classification Search
CPC ..... E04H 1/12; E04H 1/125; E04B 1/8218
See application file for complete search history.

(56) References Cited

U.S. PATENT DOCUMENTS 2,927,665 A * 3/1960 Hauf ..... E04B 1/8218 52/584.1
6,205,716 B1 * 3/2001 Peltz ..... H04N 7/142 379/453
11,401,722 B1 * 8/2022 Jalakian ..... E04H 1/125
2004/0252184 A1 * 12/2004 Hesse ..... H04R 27/00 348/E7.079
2020/0018060 A1 * 1/2020 Watanabe ..... E04B 1/34326

FOREIGN PATENT DOCUMENTS

DE 3725544 A1 * 8/1987
DE 29712570 U1 * 10/1997 ..... E04H 1/125
DE 202019105697 U1 * 12/2019
GB 2076870 A * 12/1981 ..... E04B 1/8218

* cited by examiner

*Primary Examiner* — Christine T Cajilig
(74) *Attorney, Agent, or Firm* — Oliff PLC

(57) ABSTRACT

A secure video visitation booth configured for individual use. The booth includes a plurality of wall assemblies joined at edges to form the walls of the booth, a mesh ceiling panel supported by the wall assemblies, a bench, an A/V module in one of the wall assemblies, a door in a door opening in another of the wall assemblies and a window in yet another of the wall assemblies. Each of the wall assemblies is of a spaced double wall construction, with an acoustic insulation material between the two walls.

6 Claims, 17 Drawing Sheets

SECURE VIDEO VISITATION BOOTH

FIELD OF THE INVENTION

This invention relates to structure and apparatus that enable offenders who are incarcerated in a correctional facility to have audio and visual contact with persons who are not in the correctional facility. More particularly, this invention relates to structure and apparatus that provide private audio and visual communications between incarcerated offenders in a correctional facility and persons who are not in the correctional facility.

BACKGROUND OF THE INVENTION

Correctional facilities have a need for enabling communications between incarcerated offenders and persons who are not in the correctional facilities, such as for judicial hearings, communications between incarcerated offenders and their lawyers, mental competency hearings, religious activities, family and friend visits, and medical consultations. While some of those communications can occur verbally via telephone or other audio-only communication equipment, without video or visual contact, it is desirable, necessary and/or required that some of those communications include visual communications, either in person, i.e., face-to-face, or by video. Those visual communications can be accomplished by either providing the non-correctional facilities persons that are to be a party to those communications access to the particular correctional facility for face-to-face or video contact with the offenders or transporting the incarcerated offenders off-site, such as, for example, to a court house, for such communications. Moreover, many of those communications must be in private, such as lawyer consultations.

However, there are many issues that arise from providing non-correctional facility personnel access to correctional facilities or transporting incarcerated persons off-site for communications with non-correctional facility personnel, including cost, safety, security and increased risk of disease transmission. As to the latter, correctional facilities can be devastated by entry of a communicable disease such as Covid into a correctional facility population.

Accordingly, there exists a need for a way to provide private audio and visual communications between incarcerated offenders and non-correctional facility persons that is cost-effective, secure, safe and reduces the risk of disease transmission.

The secure video visitation booths of this invention address that need and other needs that will become apparent to those of skill in the art given this disclosure.

SUMMARY OF THE INVENTION

The secure video visitation booths of this invention enable private audio and visual communications between incarcerated offenders and non-correctional facility persons without transporting the incarcerated offenders from the correctional facility to another location or permitting the non-correctional facility persons entry into the correctional facility.

Specifically, the secure video visitation booths of some embodiments of this invention include a plurality of wall assemblies joined at edges to form the walls of the secure video visitation booths, a mesh ceiling panel supported by the plurality of wall assemblies, a bench, an A/V communication module in one of the wall assemblies, a doorway in another of the wall assemblies and a door rotatably attached to the doorway.

The wall assemblies of the secure video visitation booths of certain embodiments of this invention may include a double wall construction with two spaced facing plates. One of those plates may include the exterior surface of the wall assemblies, and the other of those plates may include the interior surface of the wall assemblies. An acoustic insulation material may be between and/or attached to one of the two plates.

In the secure video visitation booths of other embodiments of this invention, the plurality of wall assemblies, and the mesh ceiling panel may be sized for individual use.

The secure video visitation booths of some embodiments of this invention may include a foundation assembly configured to be placed on and supported by an existing floor, a floor assembly supported by the foundation assembly and configured to include a floor surface of the secure video visitation booths.

The secure video visitation booths of this invention have many advantages and benefits, including the following.

First, for audio and visual communications between incarcerated offenders and non-correctional facility persons that cannot be conducted entirely at the correctional facility, such as judicial hearings, those communications can occur without transporting the incarcerated offenders from the correctional facility. That saves money and staff time that would be needed to transport the incarcerated offenders offsite, improves public safety and security for correctional facility staff and the general public, and reduces the exposure to communicable diseases by the incarcerated offenders and persons transporting the incarcerated offenders.

Second, for audio and visual communications between incarcerated offenders and non-correctional facility persons that are not required to be conducted off-site, and thus may be conducted in the correctional facility, such as lawyer consultations and family and friend visits, those communications can occur in private without the non-correctional facility persons being in the facility. That again saves money and staff time needed to permit the non-correctional facility persons access to the facility and monitor those persons and their interactions with the incarcerated offenders, improves security for correctional facility staff and reduces the risk of transmission of communicable diseases.

Third, the secure video visitation booths of this invention can be readily installed in an existing room or other building space of a correctional facility. Capital improvements to the correctional facility may not be necessary for the installation and use of the secure video visitation booths of this invention.

Fourth, a plurality of the secure video visitation booths of this invention can be arranged in a room or other building space of a correctional facility such that a single corrections officer or a single team of corrections officers can monitor a plurality of incarcerated offenders who are simultaneously and separately participating in audio/visual communications with non-correctional institution persons from a single observation point. That further saves money and staff time.

Fifth, the secure video visitation booths of this invention enable private conversations between incarcerated offenders and non-correctional facility persons.

Sixth, any desired audio/visual equipment can be utilized in the secure video visitation booths of this invention.

DETAILED DESCRIPTION OF DRAWINGS

Figure 2:
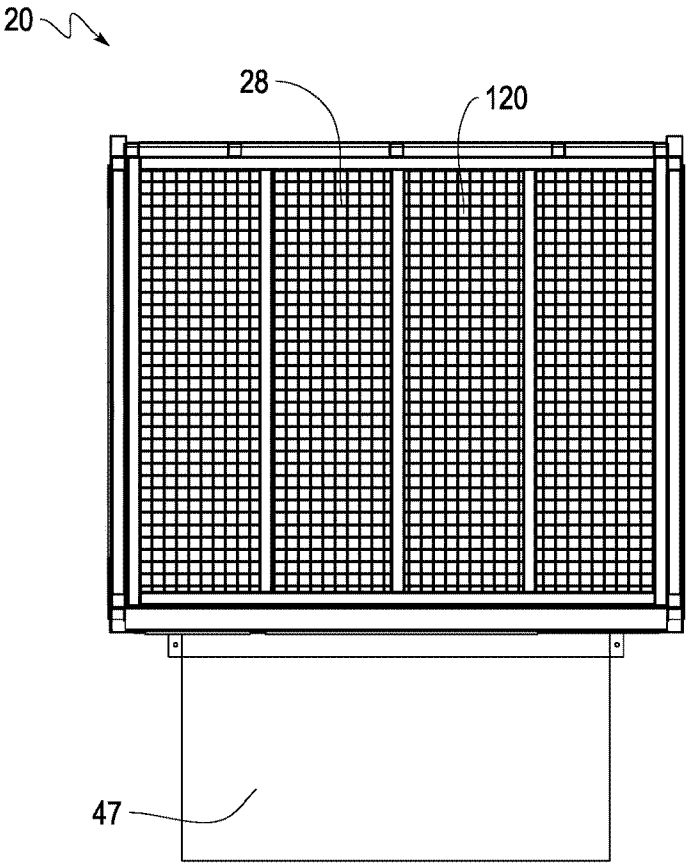
FIG. 2 is a plan view of the embodiment of this invention illustrated in FIG. 1.
Figure 1:
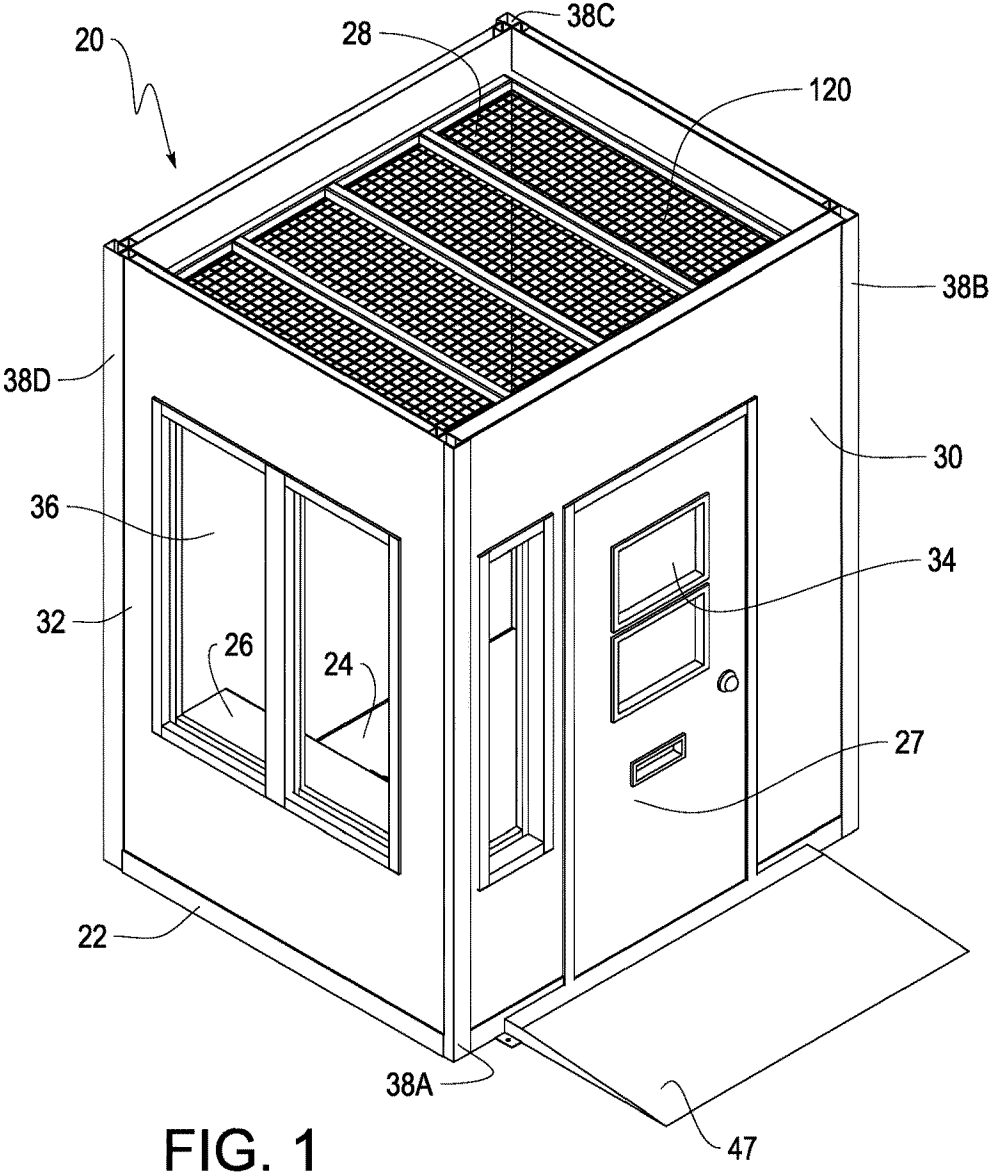
FIG. 1 is a top perspective view of a secure video visitation booth of an embodiment of this invention.
Figure 4:
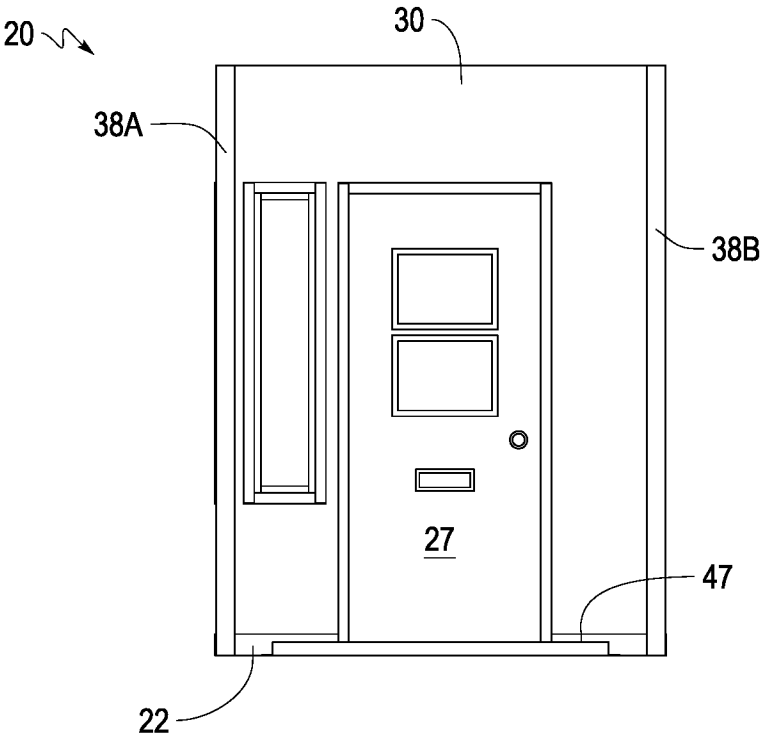
FIG. 4 is a front elevation view of the embodiment of this invention illustrated in FIGS. 1-3.
Figure 3:
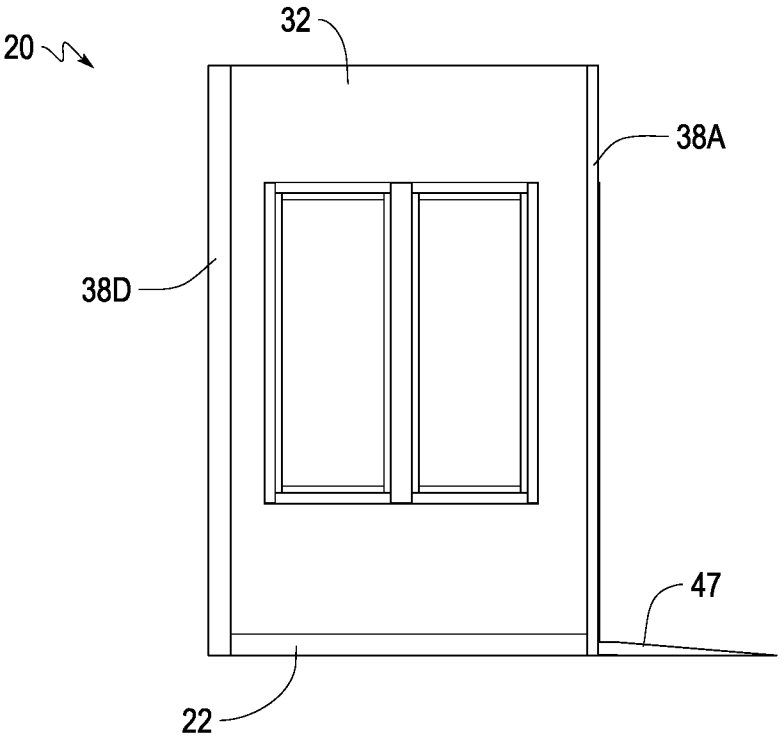
FIG. 3 is a side elevation view of the embodiment of this invention illustrated in FIGS. 1 and 2.
Figure 5:
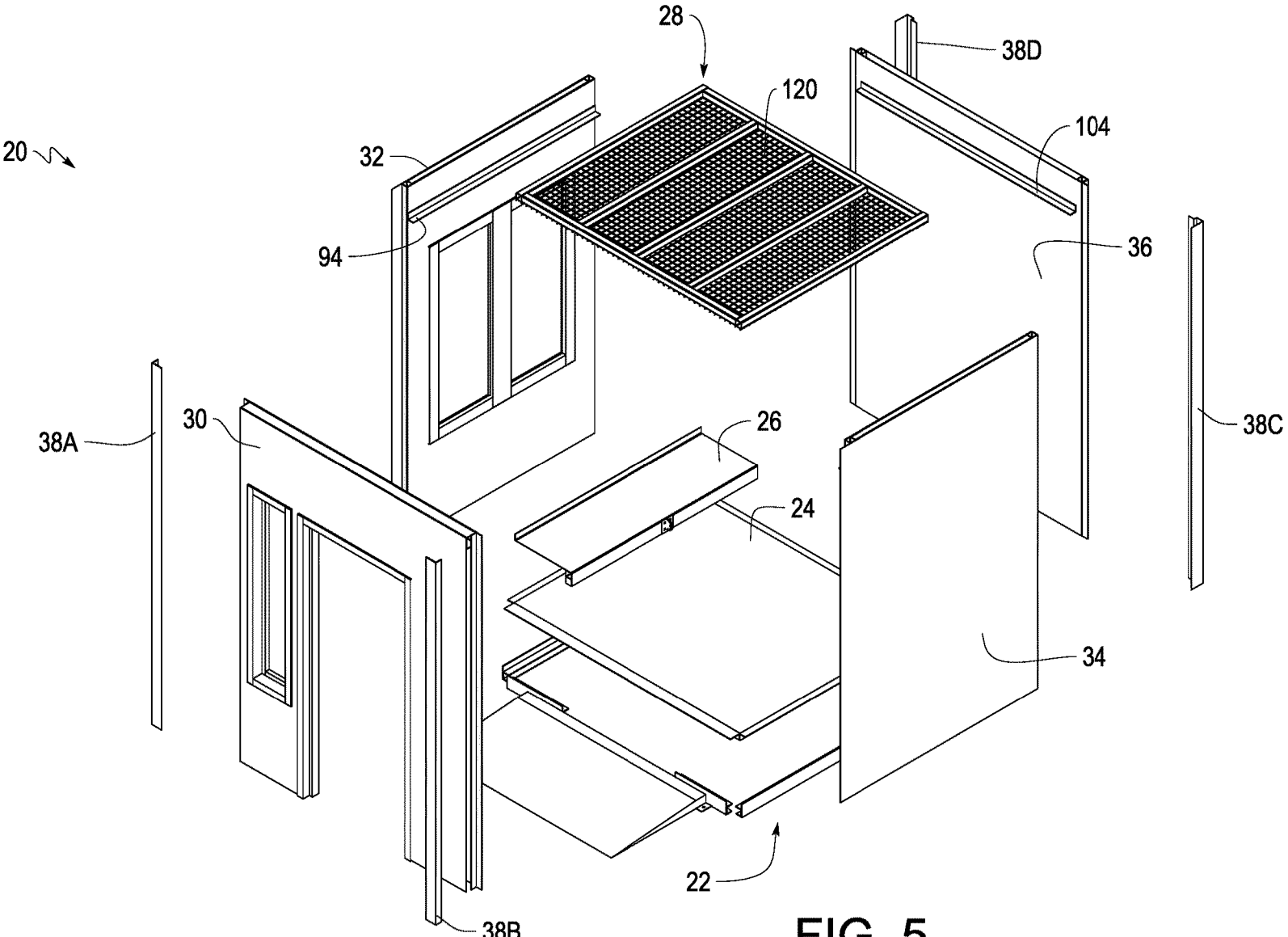
FIG. 5 is an exploded, top perspective view of the embodiment of this invention illustrated in FIGS. 1-4.

As stated, a secure video visitation booth of an embodiment of this invention, secure video visitation booth 20, is illustrated in FIGS. 1-26, 30, 32 and 33.

Secure video visitation booth 20 includes foundation assembly 22, floor assembly 24, bench 26, door 27, ceiling panel 28, front wall assembly 30, first side wall assembly 32, second side wall assembly 34, back wall assembly 36, front corner angles 38A and 38B and back corner closure plates 38C and 38D.

Figure 6:
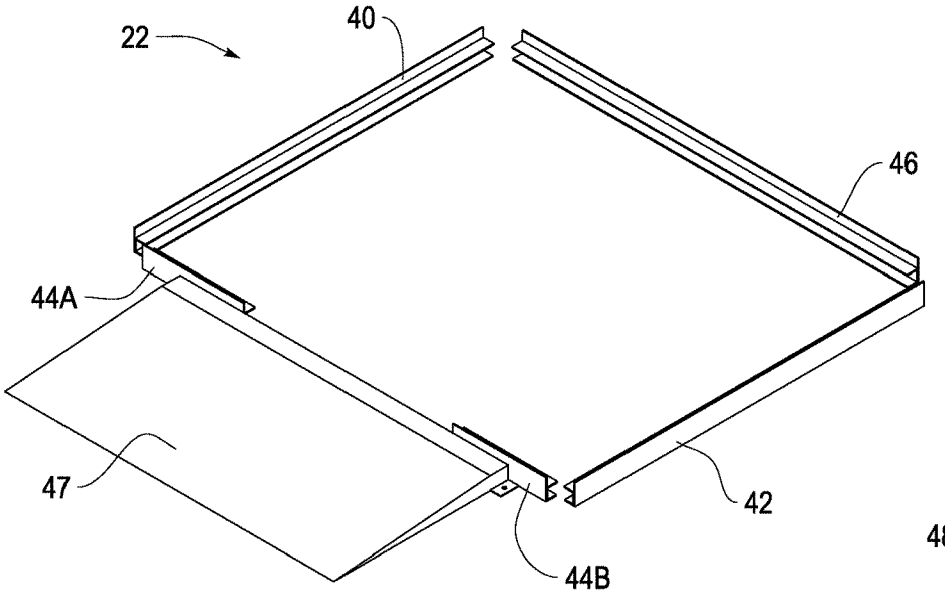
FIG. 6 is an exploded, top perspective view of the foundation assembly of the embodiment of this invention illustrated in FIGS. 1-5.

In this embodiment of the invention, foundation assembly 22 includes side members 40 and 42, back member 46, front members 44A and 44B and ramp 47, as shown in FIG. 6. Side member 40 extends between and is connected at its ends to front member 44A and back member 46. Side member 42 extends between and is connected at its ends to front member 44B and back member 46. Back member 46 extends between and is connected at its end to side members 40 and 42.

The front of foundation assembly 22 is formed by front members 44A and 44B and ramp 47. One end of front member 44A is connected to an end of side member 40. One end of front member 44B is connected to an end of side member 42. Front members 44A and 44B are longitudinally spaced. Ramp 47 is in that longitudinal gap between front members 44A and 44B and is fixedly attached to those members.

Figure 7:
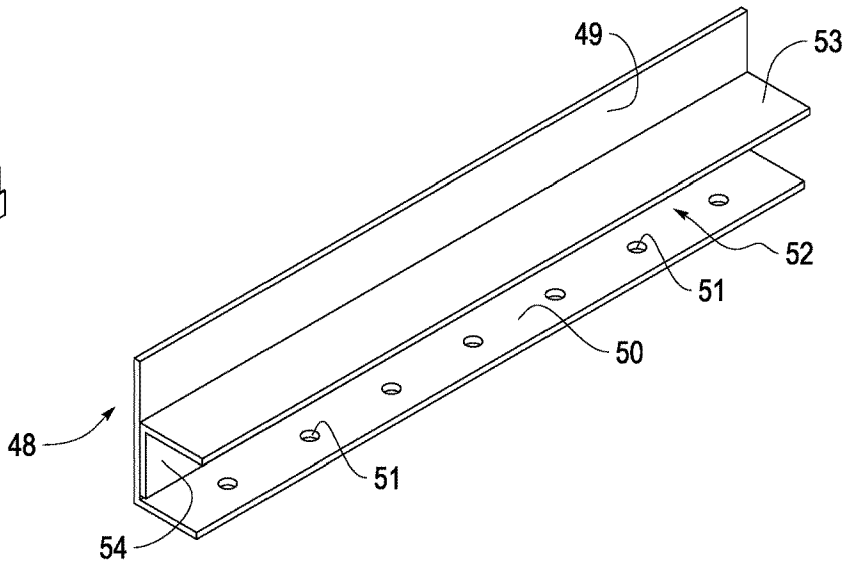
FIG. 7 is a top perspective view of the front, back and side members of the foundation assembly illustrated in FIG. 6.

Each of side members 40 and 42, back member 46 and front members 44A and 44B are comprised of angles 48 and 52, as shown in FIG. 7. Angle 48 includes first flange 49 and second flange 50. Angle 52 includes first flange 53 and second flange 54. As shown in FIG. 7, angles 48 and 52 are relatively positioned and connected such that first flange 49 of angle 48 and second flange 54 of angle 52 abut and are connected by welding or other attachment method and second flange 50 of angle 48 and first flange 53 of angle 52 are spaced and parallel, as shown in FIG. 7.

Figure 30:
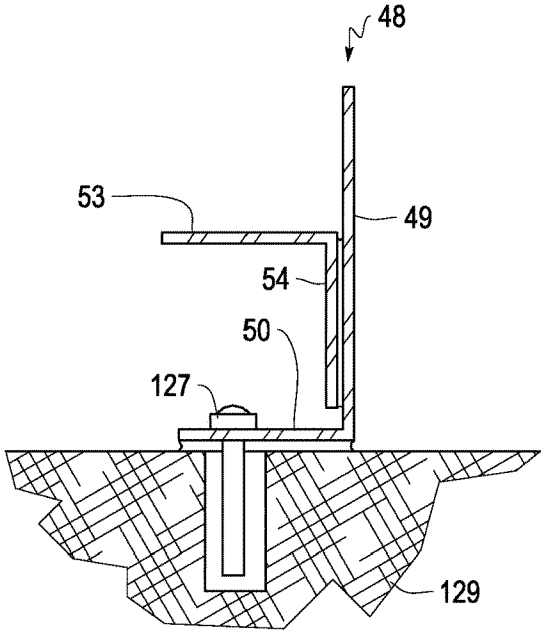
FIG. 30 is a side view showing the attachment of the foundation assembly illustrated in FIGS. 6 and 7 to an existing floor.

Second flange 50 includes a series of spaced holes 51 configured to receive anchor fasteners 127, to attach secure video visitation booth 20 to an existing floor, such as floor 129, as shown in FIG. 30.

While foundation assembly 22 of this embodiment of the invention includes side members 40 and 42, front members 44A and 44B, back member 46 and ramp 47, the foundation assemblies of the secure video visitation booths of other embodiments of this invention may include other members if such other members provide the necessary integrity and strength to serve as the foundations for the secure video visitation booths of other embodiments of this invention. Further, those other members do not have to define a rectangular frame, such as defined by foundation assembly 22. Rather, those other members can define other symmetrical shapes, or even non-symmetrical shapes. Finally, while, in this embodiment of the invention, the individual members of side members 40 and 42, front members 44A and 44B and back member 46 comprise angles 48 and 52 assembled as shown in FIG. 7, any other structural members can be used instead of angles 48 and 52, as long as those other members have sufficient integrity and strength to support the floor assembly and all other members and assemblies of the secure video visitation booths of other embodiments of this invention.

Also, in this embodiment of the invention, the ends of side members 40 and 42, front members 44A and 44B and back member 46 are connected, and ramp 47 is connected to front members 44A and 44B, by welding. In other embodiments of this invention, attachment means/methods other than welding can be utilized to connect those members, as long as the other attachment means/methods sufficiently connect those members.

Ramp 47 is optional and can be designed to be ADA compliant.

Figure 10:
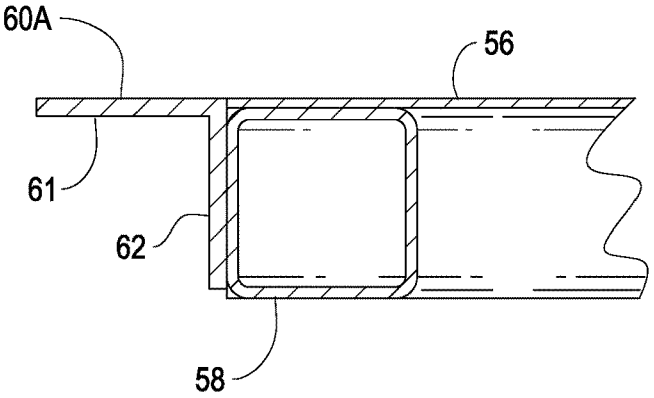
FIG. 10 is a cross-sectional view along line 10-10 of FIG. 8.
Figure 8:
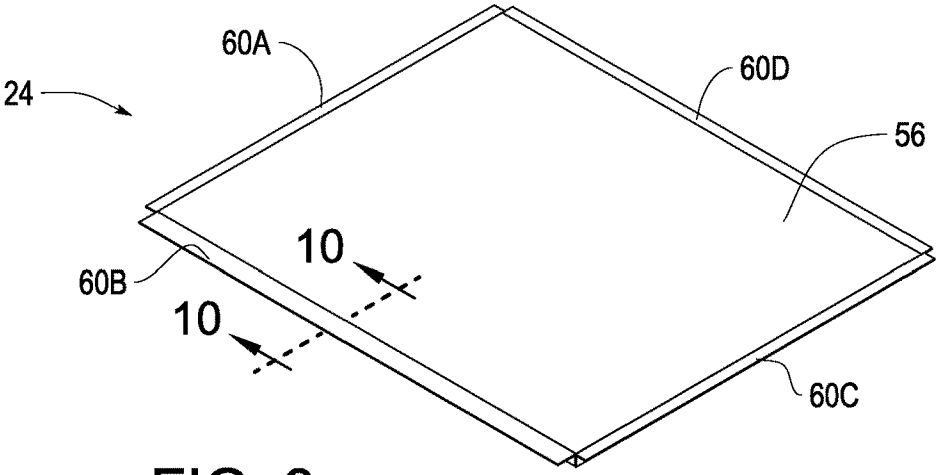
FIG. 8 is a top perspective view of the floor assembly of the embodiment of this invention illustrated in FIGS. 1-5.
Figure 9:
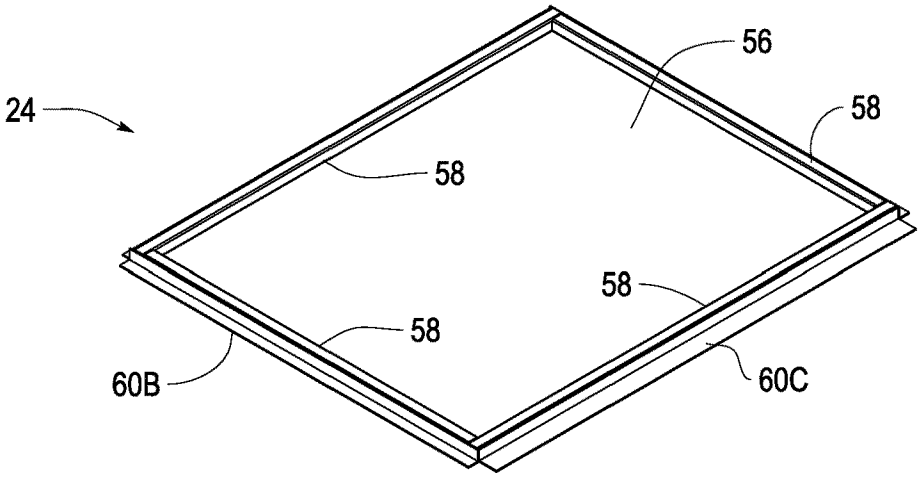
FIG. 9 is a bottom perspective view of the floor assembly illustrated in FIG. 8.

Floor assembly 24 includes, in this embodiment of the invention, floor plate 56, four tubes 58 and angles 60A-60D, as shown in FIGS. 8-10.

The four tubes 58 are connected on their ends to form a rectangular frame. Floor plate 56 extends across that rectangular frame and is attached to the top surfaces of tubes 58 such that the periphery of floor plate 56 is aligned with the outer periphery of the frame formed by tubes 58, as shown in FIG. 10.

Each of angles 60A-60D is connected to one of the four tubes 58, again as shown in FIG. 10. Specifically, each of angles 60A-60D includes first flange 61 and second flange 62. Second flange 62 abuts and is connected to the outer surface of one of tubes 58, such that the top surfaces of first flange 61 and floor plate 56 are substantially co-planar.

In this embodiment of the invention, angles 60A-D and floor plate 56 are attached to the four tubes 58 by welding. In other embodiments of this invention, attachment means/methods other than welding can be utilized to connect those members, as long as the other attachment means/methods sufficiently connect those members.

Also, while, in this embodiment of the invention, floor assembly 24 includes floor plate 56, four tubes 58 and angles 60A-60D, the floor assemblies of other embodiments of this invention can include other structural members, as long as the other structural members provide sufficient integrity and strength for the floor assembly.

Moreover, other embodiments of this invention do not include a foundation assembly or a floor assembly as explained below.

In this embodiment of the invention, front wall assembly 30 includes vertical tubes 64A-64D, window frame assembly 66, door frame assembly 68, top horizontal tube 72, exterior facing plate 74, interior facing plate 76, vertical edge angles 77A and 77B and interior angle 78, as shown in FIGS. 11-15.

Figure 12:
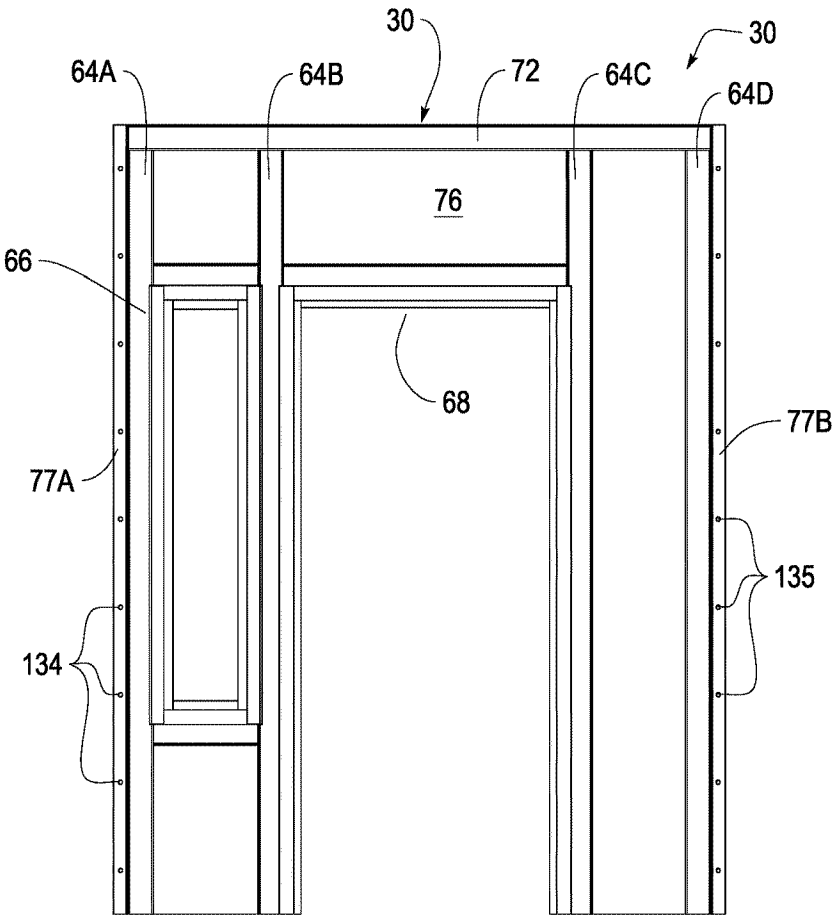
FIG. 12 is an exterior elevation view of the front wall assembly illustrated in FIG. 11, with its exterior facing plate removed.

Vertical tubes 64A-64D are spaced as shown in FIG. 12. Window frame assembly 66 is attached to and supported by vertical tubes 64A and 64B. Door frame assembly 68 is attached to and supported by vertical tubes 64B and 64C. Top horizontal tube 72 extends across and is attached to the top ends of vertical tubes 64A-64D.

Figure 34:
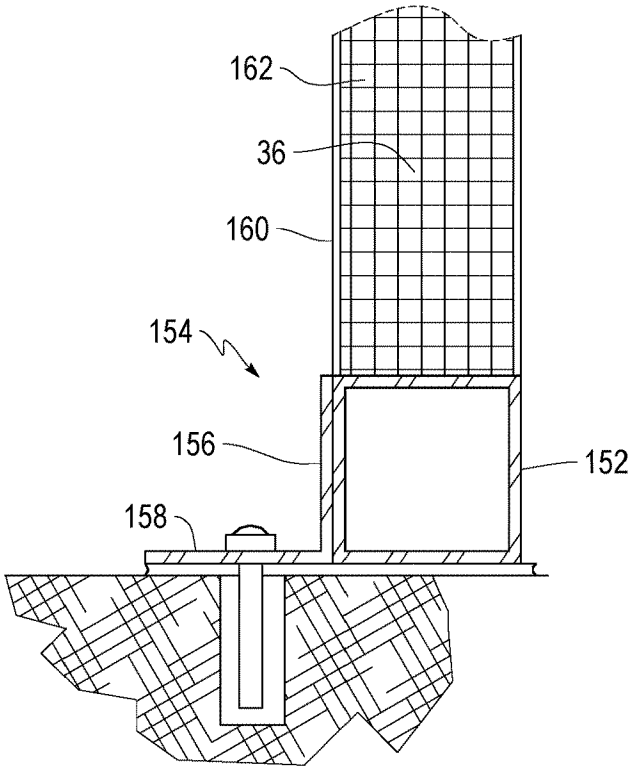
FIG. 34 is a partial, cross-sectional side view of a wall assembly of a secure video visitation booth of another embodiment of this invention and of a bracket utilized to attach the wall assembly to an existing floor.

Exterior facing plate 74 is attached to the exterior faces of vertical tubes 64A-64D and top horizontal tube 72. Interior facing plate 76 is attached to the interior faces of vertical tubes 64A-64D and top horizontal tube 72. Interior facing plate 76 may be comprised of one or more sound adsorbing panels, such as the Steel Eckel Correctional Panel Type-2F. Alternatively, interior facing plate 76 may be comprised of perforated steel plate 160 with acoustical blanket 162 on the surface of perforated steel plate 160 facing exterior facing plate 74, as shown in FIG. 34. The inclusion of exterior facing plate 74 and interior facing plate 76 results in front wall assembly 30 having a spaced double wall construction.

Vertical edge angles 77A and 77B are on opposite edges of front wall assembly 30.

Figure 15:
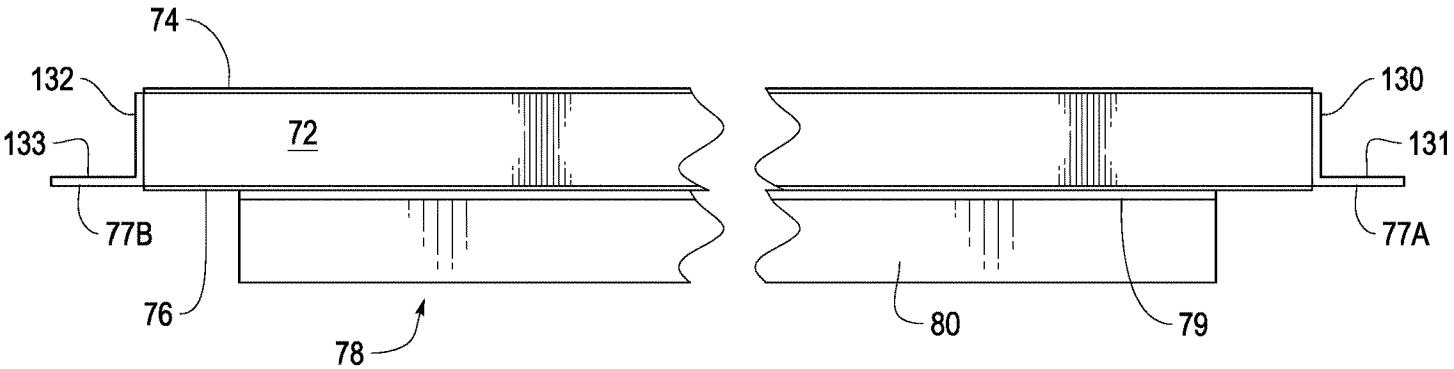
FIG. 15 is a plan view of the front wall assembly illustrated in FIGS. 11-14.

Vertical edge angle 77A includes flanges 130 and 131 and vertical edge angle 77B includes flanges 132 and 133, as shown in FIG. 15. Flanges 131 and 133 include series of spaced holes 134 and 135, respectively.

Flange 130 of vertical edge angle 77A is welded to vertical tube 64A. Flange 132 of vertical edge angle 77B is welded to vertical tube 64D.

Figure 14:
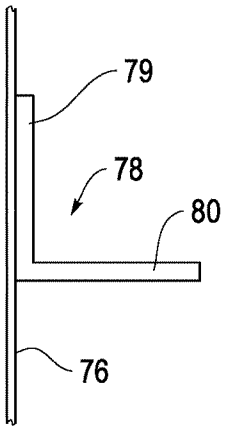
FIG. 14 is a partial side elevation view of the interior facing plate and the interior angle of the front wall assembly illustrated in FIGS. 11-13.

As shown in FIG. 14, interior angle 78 is attached to the interior surface of interior facing plate 76 and includes first flange 79 and second flange 80. First flange 79 is parallel to, abuts and is attached to interior facing plate 76. Second flange 80 extends perpendicular to interior facing plate 76 and is a support for ceiling panel 28, as described below.

While, in this embodiment of the invention, front wall assembly 30 includes vertical tubes 64A-64D, window frame assembly 66, door frame assembly 68, top horizontal tube 72, exterior facing plate 74, interior facing plate 76, vertical edge angles 77A and 77B and interior angle 78, the front wall assemblies of the secured video visitation booths of other embodiments of this invention may include other structural members, as long as those other structural members provide the structural integrity and strength necessary for a front wall assembly of the secure video visitation booths of this invention.

In this embodiment of the invention, first side wall assembly 32 includes vertical tubes 84A-84C, window frame assemblies 86A and 86B, top horizontal tube 88, exterior facing plate 90, interior facing plate 92, vertical edge tubes 93A and 93B, and interior angle 94, as shown in FIGS. 16-19.

Figure 17:
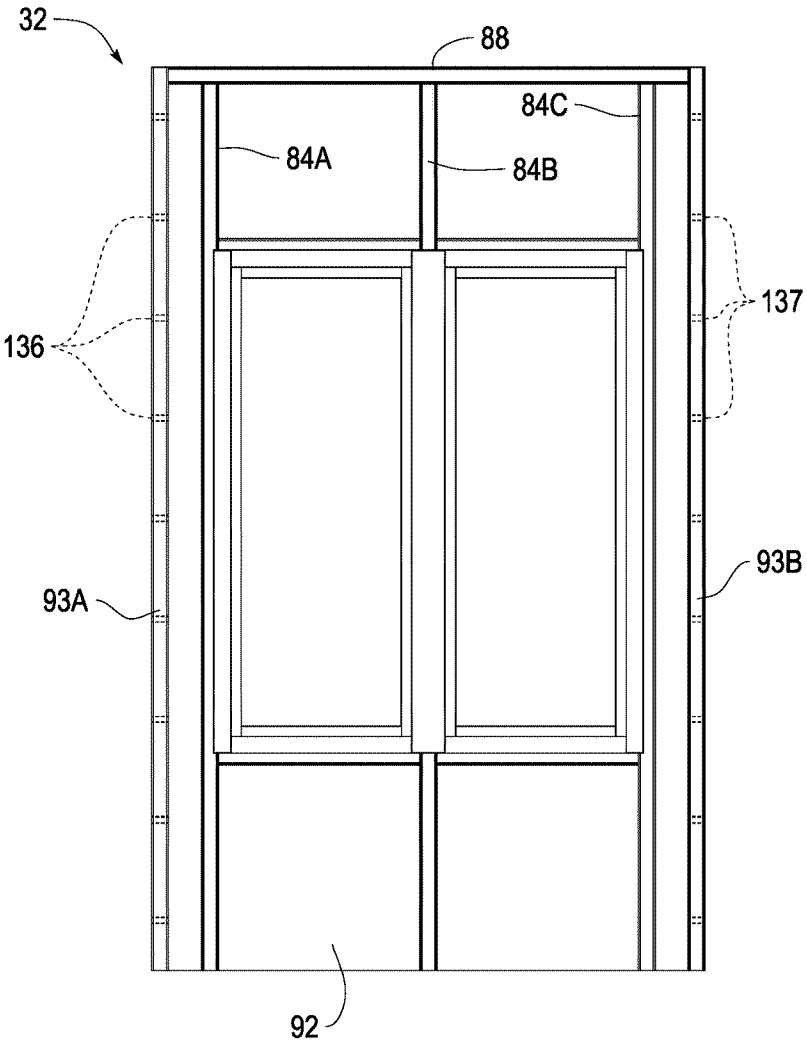
FIG. 17 is an exterior elevation view of the first side wall assembly illustrated in FIG. 16, with its exterior face plate removed.
Figure 16:
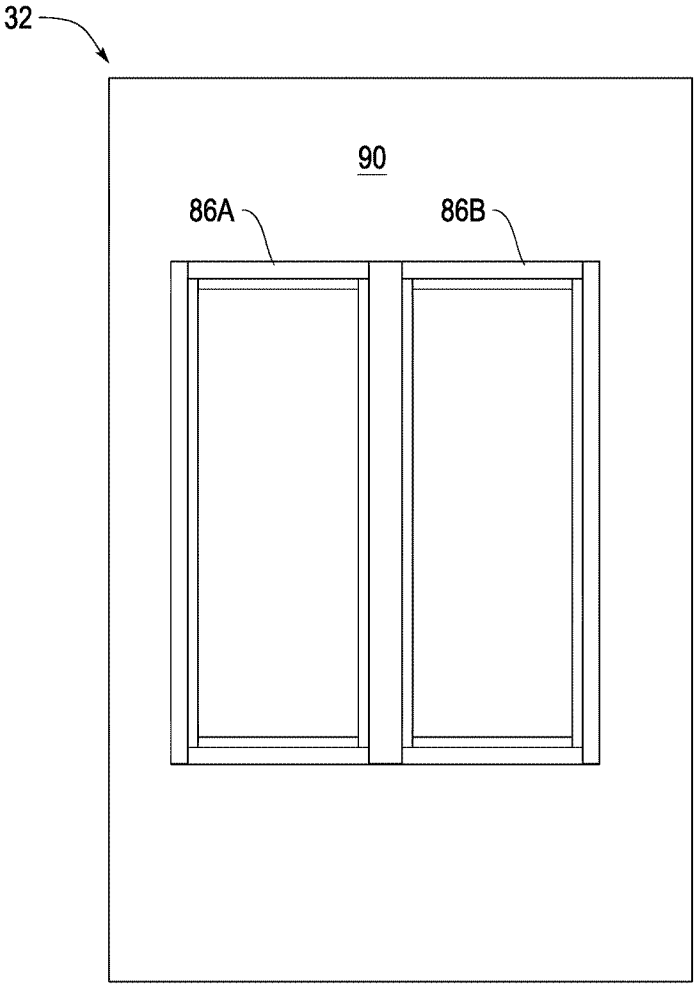
FIG. 16 is an exterior elevation view of the first side wall assembly of the embodiment of this invention illustrated in FIGS. 1-5.
Figure 19:
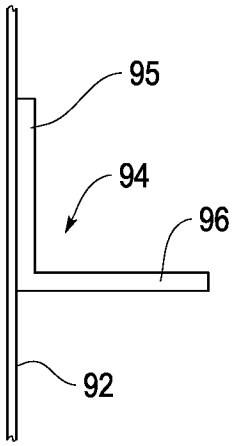
FIG. 19 is a partial side elevation view of the interior facing plate and the interior angle of the first sidewall assembly illustrated in FIGS. 16-18.

Vertical tubes 84A-84C are spaced as shown in FIG. 17. Window frame assembly 86A is attached to and supported by vertical tubes 84A and 84B. Window frame assembly 86B is attached to and supported by vertical tubes 84B and 84C. Top horizontal tube 88 extends across and is attached to the top ends of vertical tubes 84A-84C.

Exterior facing plate 90 is attached to the exterior faces of vertical tubes 84A-84C and top horizontal tube 88. Interior facing plate 92 is attached to the interior faces of vertical tubes 84A-84C and top horizontal tube 88. Interior facing plate 92 may be comprised of one or more sound adsorbing panels, the same as interior facing plate 76, discussed above. Also, similar to interior facing plate 76, interior facing plate 92 may alternatively be comprised of a perforated steel plate and an acoustical blanket. The inclusion of exterior facing plate 90 and interior facing plate 92 results in first side wall assembly 32 having a spaced double wall construction.

Vertical edge tubes 93A and 93B are on opposite vertical edges of first side wall assembly 32 and have series of spaced holes 136 and 137, respectively. The top ends of vertical edge tubes 93A and 93B are attached to opposite ends of the top horizontal tube 88.

Figure 18:
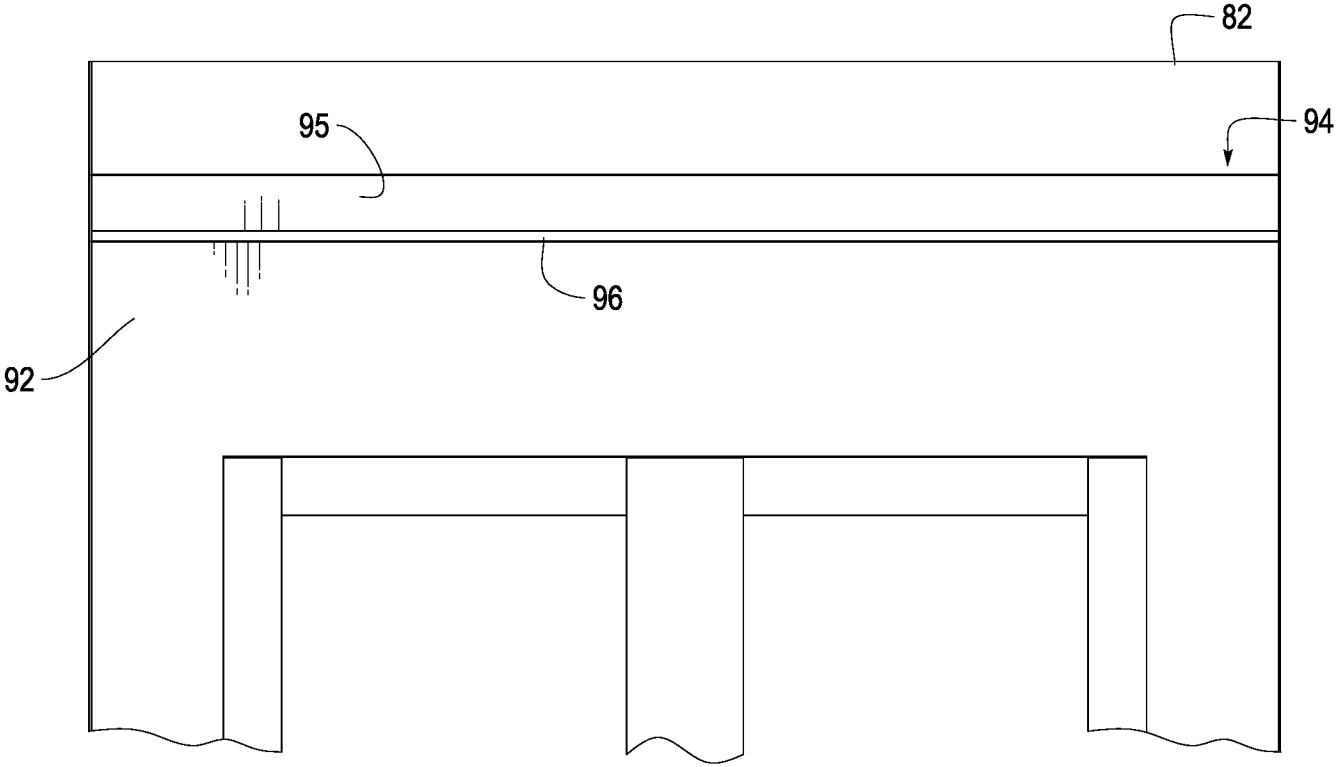
FIG. 18 is a partial interior elevation view of the first side wall assembly illustrated in FIGS. 16 and 17.

As shown in FIG. 18, interior angle 94 is attached to the interior surface of interior facing plate 92 and includes first flange 95 and second flange 96. First flange 95 is parallel to, abuts and is attached to interior facing plate 92. Second flange 96 is perpendicular to interior facing plate 92 and is a support for ceiling panel 28, as described below.

While, in this embodiment of the invention, first side wall assembly 32 includes vertical tubes 84A-84C, window frame assemblies 86A and 86B, top horizontal tube 88, exterior facing plate 90, interior facing plate 92, vertical edge tubes 93A and 93B and interior angle 94, the first side wall assemblies of the secure video visitation booths of other embodiments of this invention may include other structural members, as long as those other structural members provide the structural integrity and strength for a side wall assembly of the secure video visitation booths of this invention.

Figure 22:
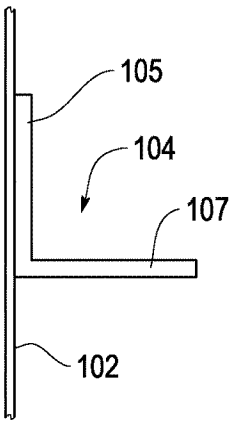
FIG. 22 is a partial side elevation view of the interior facing plate and the interior angle of the back wall assembly illustrated in FIGS. 20 and 21.
Figure 21:
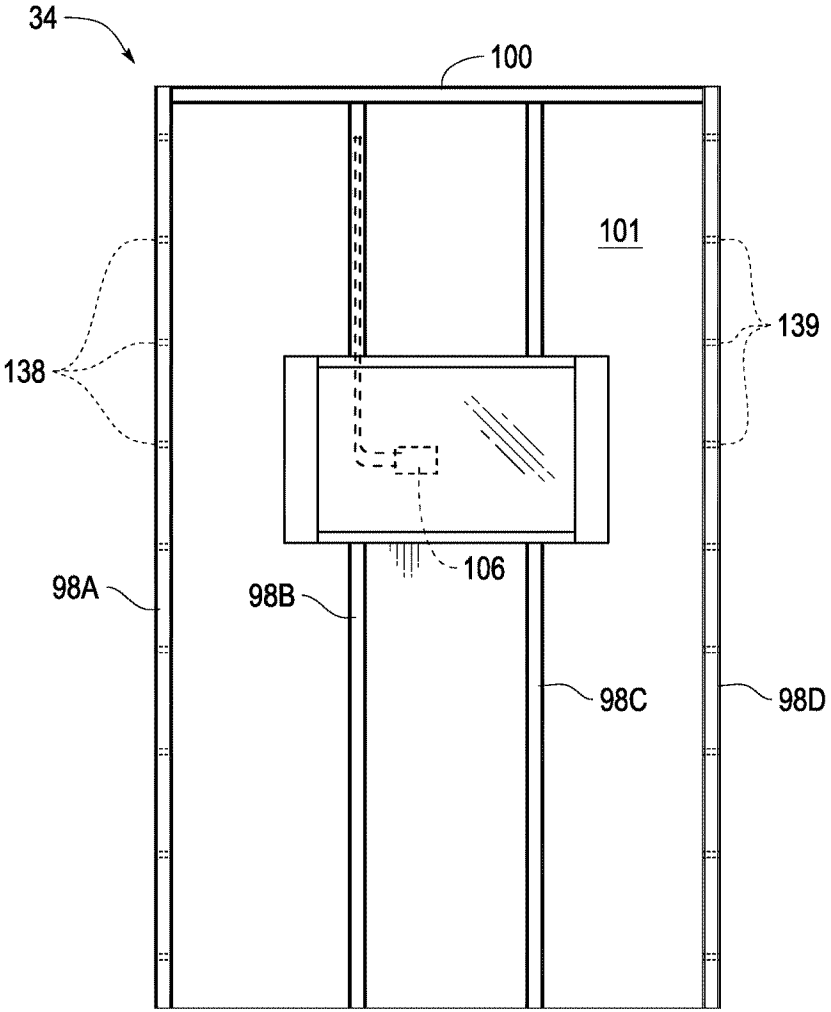
FIG. 21 is an interior elevation view of the back wall assembly illustrated in FIG. 20, with its interior facing plate removed.
Figure 20:
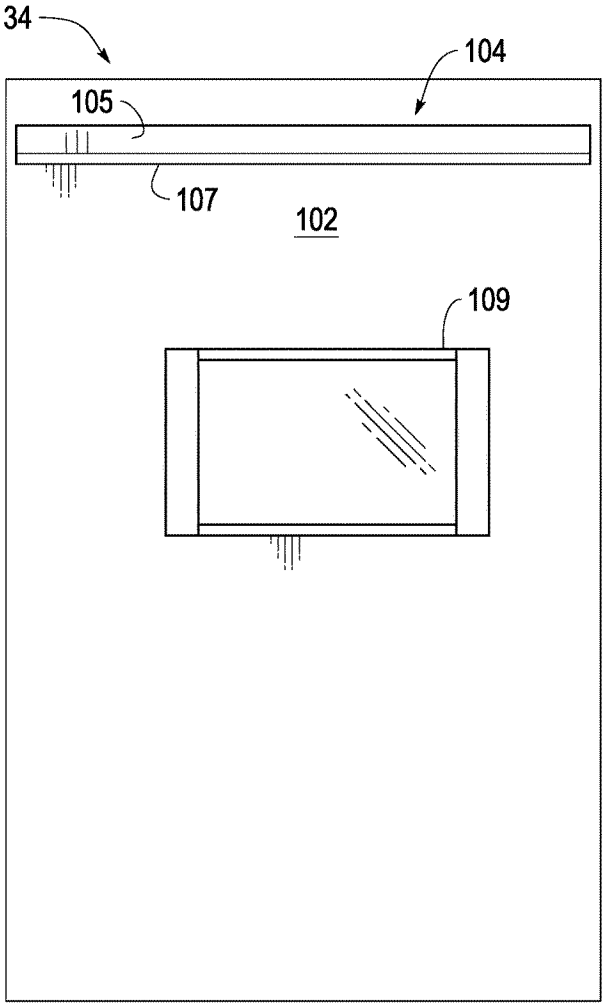
FIG. 20 is an interior elevation view of the back wall assembly of the embodiment of this invention illustrated in FIGS. 1-5.

In this embodiment of the invention, second wall assembly 34 includes vertical tubes 98A-98D, top horizontal tube 100, exterior facing plate 101, interior facing plate 102, interior angle 104 and A/V communications module 106, as shown in FIGS. 20-22.

Vertical tubes 98A-98D are spaced as shown in FIG. 20. Vertical tubes 98A and 98D have series of spaced holes 138 and 139, respectively. Top horizontal tube 100 extends across and is connected to the top ends of vertical tubes 98B and 98C. The top ends of vertical tubes 98A and 98D are attached to opposite ends of top horizontal tube 100.

Exterior facing plate 101 is attached to the exterior faces of vertical tubes 98A-98D and top horizontal tube 100. Interior facing plate 102 is attached to the interior faces of vertical tubes 98A-98D and horizontal tube 100. Interior facing plate 102 may be comprised of one or more sound absorbing panels, the same as interior facing plates 76 and 92, discussed above. Also, similar to interior facing plates 76 and 92, interior facing plate 102 may alternatively be comprised of a perforated steel plate and an acoustical blanket. The inclusion of exterior facing plate 101 and interior facing plate 102 results in back wall assembly 36 having a spaced double wall construction.

As shown in FIG. 21, interior angle 104 is attached to the interior surface of interior facing plate 102 and includes first flange 105 and second flange 107. First flange 105 is parallel to, abuts and is attached to interior facing plate 102. Second flange 107 is perpendicular to interior facing plate 102 and is a support for ceiling panel 28, as described below.

A/V communications module 106 is attached to and supported by one or more of vertical tubes 98B and 98C, exterior facing plate 101 and interior facing plate 102. A/V communications module 106 can be of any of the A/V communications modules that are known in the art. A video monitor, such as video monitor 109 in FIGS. 20 and 21, can be attached to A/V communications module 106.

In the secure video visitation booths of some embodiments of this invention, a clear, shatterproof barricade may be installed in front of the video monitor to preclude access to the monitor from inside the booths.

While, in this embodiment of the invention, second side wall assembly 34 includes vertical tubes 98A-98D, top horizontal tube 100, exterior facing plate 101, interior facing plate 103 and interior angle 104, the second side wall assemblies of the secure video visitation booths of other embodiments of this invention may include other structural members, as long as those other structural members provide the structural integrity and strength for a side wall assembly of the secure video visitation booths of this invention.

In this embodiment of the invention, back wall assembly 36 includes vertical tubes 108A-108D, top horizontal tube 110, exterior facing plate 112, interior facing plate 114, interior angle 116 and vertical edge angles 140 and 141, as shown in FIGS. 23-26.

Figure 23:
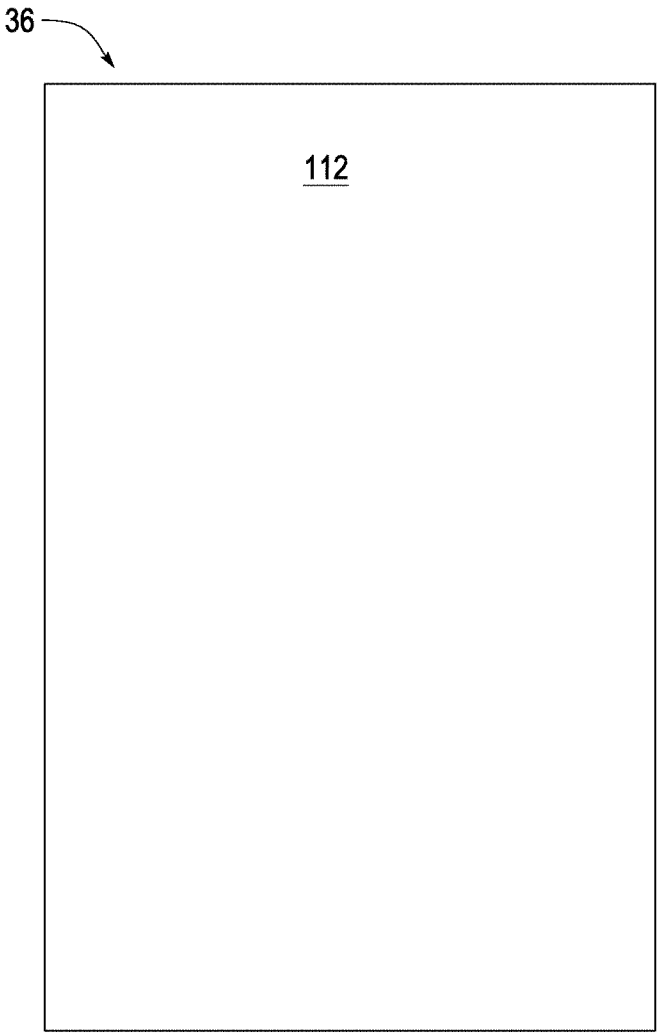
FIG. 23 is an exterior elevation view of the second side wall assembly of the embodiment of this invention illustrated in FIGS. 1-5.

Vertical tubes 108A-108D are spaced as shown in FIG. 23. Top horizontal tube 110 extends across and is connected to the top ends of vertical tubes 108B and 108C. The top ends of vertical tubes 108A and 108D are attached to opposite ends of top horizontal tube 110.

Exterior facing plate 112 is attached to the exterior faces of vertical tubes 108A-108D and top horizontal tube 110. Interior facing plate 114 is attached to the interior faces of vertical tubes 108A-108D and top horizontal tube 110. Interior facing plate 114 may be comprised of one or more sound absorbing panels, the same as interior facing plates 76, 92 and 102, discussed above. Also, similar to interior facing plates 76, 92 and 102, interior facing plate 114 may alternatively be comprised of a perforated steel plate and an acoustical blanket. The inclusion of exterior facing plate 112 and interior facing plate 114 results in second side wall assembly 34 having a spaced double wall construction.

Figure 24:
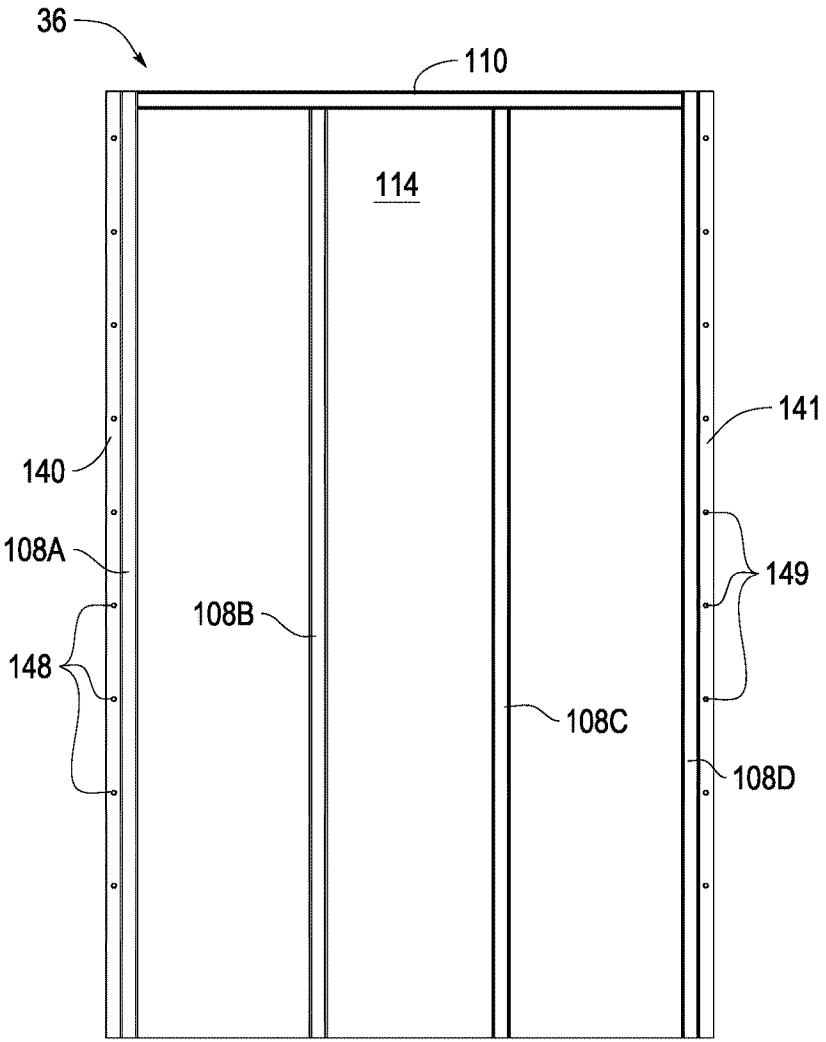
FIG. 24 is an exterior elevation view of the second side wall assembly illustrated on FIG. 23, with its exterior facing plate removed.

As shown in FIG. 24, interior angle 116 is attached to the interior surface of interior facing plate 114 and includes first flange 117 and second flange 118. First flange 117 is parallel to, abuts and is attached to interior facing plate 114. Second flange 118 is perpendicular to interior facing plate 114 and is a support for ceiling panel 28, as described below.

Vertical edge angle 140 includes flanges 144 and 145. Vertical edge angle 141 includes flanges 146 and 147. Flange 144 is welded to vertical tube 108A and flange 146 is welded to vertical tube 108D. Flange 145 includes a series of spaced holes 148 and flange 147 includes a series of spaced holes 149.

While, in this embodiment of the invention, back wall assembly 36 includes vertical tubes 108A-108D, top horizontal tube 110, exterior facing plate 112, interior facing plate 114, interior angle 116 and vertical edge angles 140 and 141, the back wall assemblies of other embodiments of this invention may include other structural members, as long as those other structural members provide the structural integrity and strength for a back wall assembly of the secure video visitation booths of this invention.

Ceiling panel 28 includes mesh screen 120 for ventilation purposes. Ceiling panel 28 is supported by and attached to (1) second flange 80 of interior angle 78 of front wall assembly 30, (2) second flange 96 of interior angle 94 of first sidewall assembly 32, (3) second flange 107 of interior angle 104 of back wall assembly 36 and (4) second flange 118 of interior angle 116 of second sidewall assembly 34, as described below.

Figure 28:
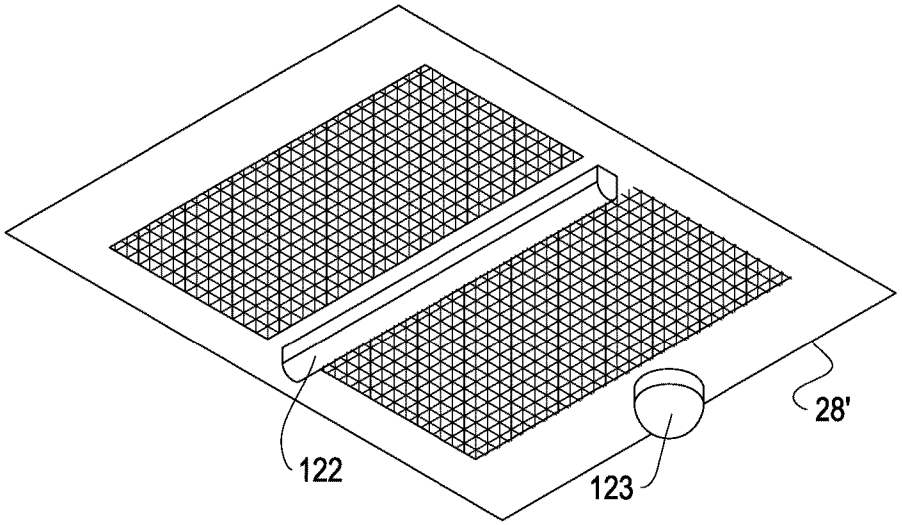
FIG. 28 is a bottom perspective view of a ceiling panel of an embodiment of this invention.

In the secure video visitation booths of some embodiments of this invention, the ceiling panel, such as ceiling panel 28' in FIG. 28, may include built-in light fixture 122 and/or surveillance camera 123.

Front corner angles 38A and 38B and back corner closure plates 38C and 38D extend the height of secure video visitation booth 20 and join front wall assembly 30, first side wall assembly 32, second side wall assembly 34 and back wall assembly 36. Specifically, front corner angle 38A is attached to and connects front wall assembly 30 and first side wall 32, front corner angle 38B is attached to and connects front wall assembly 30 and second side wall assembly 34, back corner closure plate 38C is attached to and connects second side wall assembly 34 and back wall assembly 36 and back corner closure plate 38D is attached to and connects back wall assembly 36 and first side wall assembly 32, as described below.

Foundation assembly 22, floor assembly 24, ceiling panel 28, front wall assembly 30, first side wall assembly 32, second side wall assembly 34, back wall assembly 36, front corner angles 38A and 38B and back corner closure plates 38C and 38D are assembled as follows.

Front wall assembly 30 is attached to first side wall assembly 32 and second side wall assembly 34 as follows.

Figure 11:
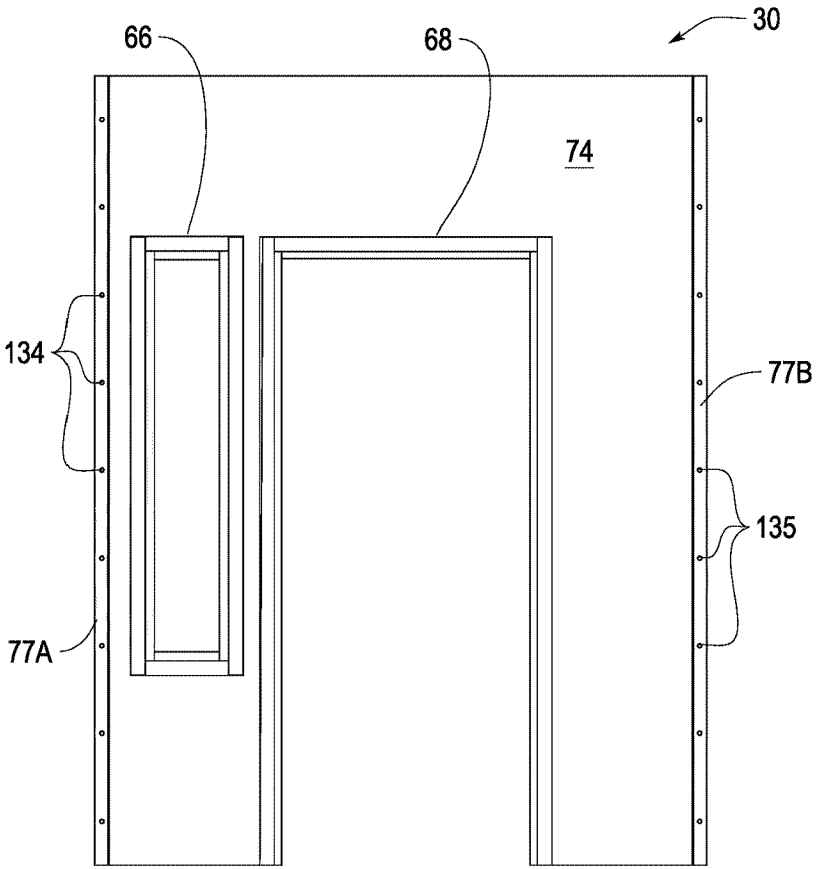
FIG. 11 is an exterior elevation view of the front wall assembly of the embodiment of this invention illustrated in FIGS. 1-5.
Figure 13:
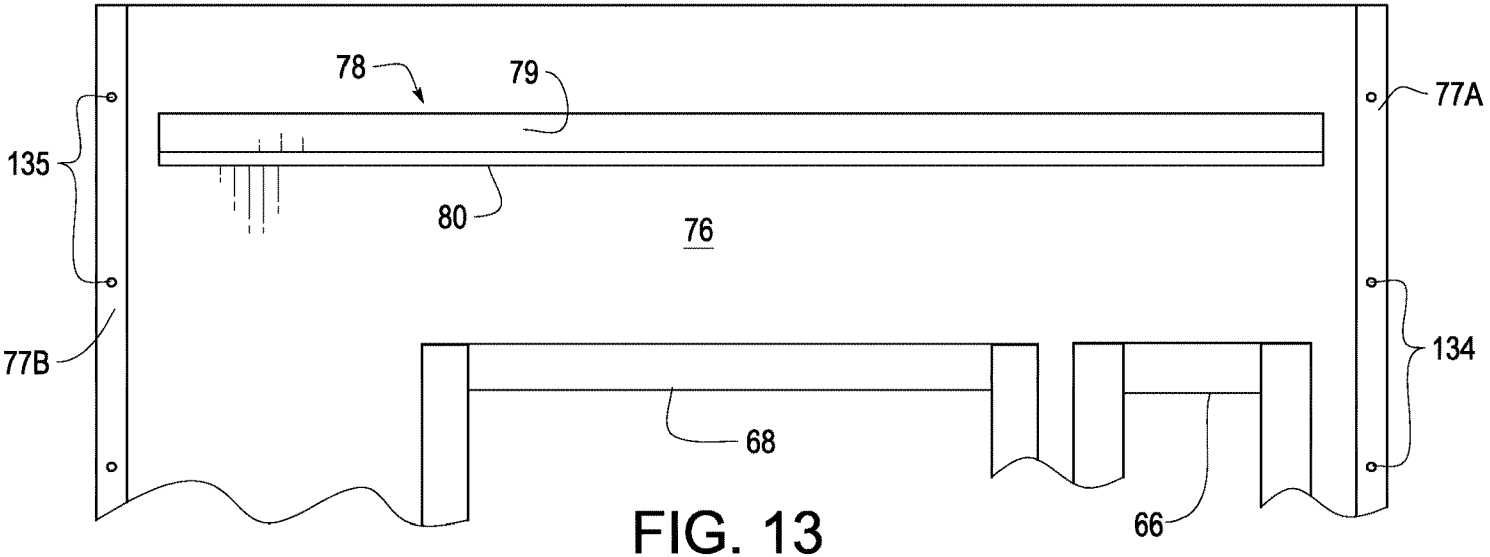
FIG. 13 is a partial interior elevation view of the front wall assembly illustrated in FIGS. 11 and 12.

As stated, flanges 131 and 133 of vertical edge angles 77A and 77B (of front wall assembly 30) have series of spaced holes 134 and 135, respectively, as shown in FIGS. 11-13.

Vertical edge tube 93B of first sidewall assembly 32 has a series of spaced holes 137 that match holes 134 in flange 131 of vertical edge angle 77A, as shown in FIG. 17. Vertical edge tube 98D of second side wall assembly 36 includes a series of spaced holes 139 that match holes 135 in flange 133 of vertical edge angle 77B, as shown in FIG. 21. Bolts or other fasteners are inserted through holes 134 and 137 to attach first side wall assembly 32 and front wall assembly 30 and through holes 135 and 139 to attach second side wall assembly 36 and front wall assembly 30.

Front corner angle 38A is then affixed to cover the joint of front wall assembly 30 and first side wall assembly 32 and front cover angle 38A is then affixed to cover the joint of front wall assembly 30 and second side wall assembly 34.

Back wall assembly 36 is attached to first side wall assembly 32 and second side wall assembly 34 as follows.

Figure 24A:
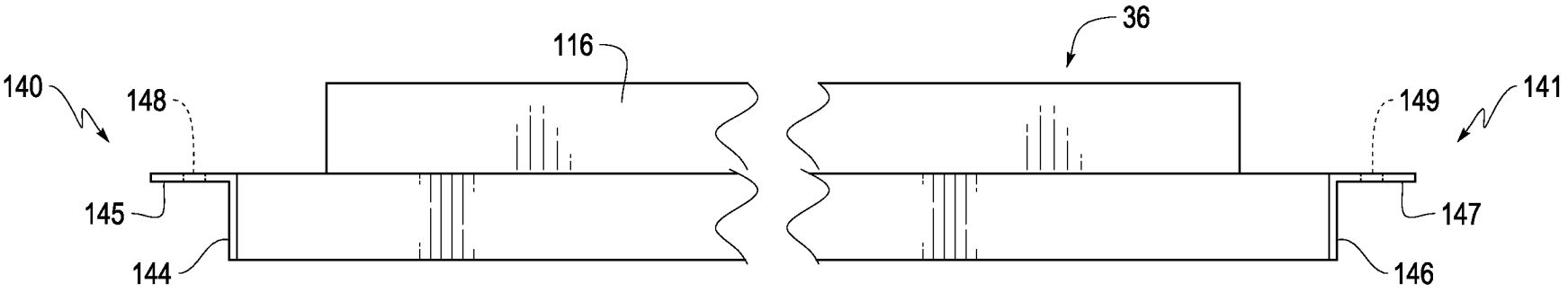
FIG. 24A is a top view of the second side wall assembly illustrated in FIGS. 23 and 24.
Figure 26:
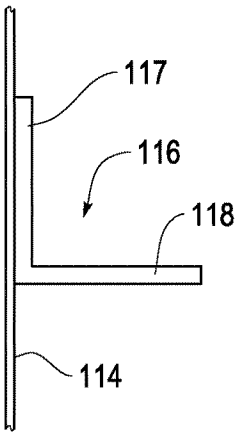
FIG. 26 is a partial side elevation view of the interior facing plate and the interior angle of the second side wall assembly illustrated in FIGS. 23-25.
Figure 25:
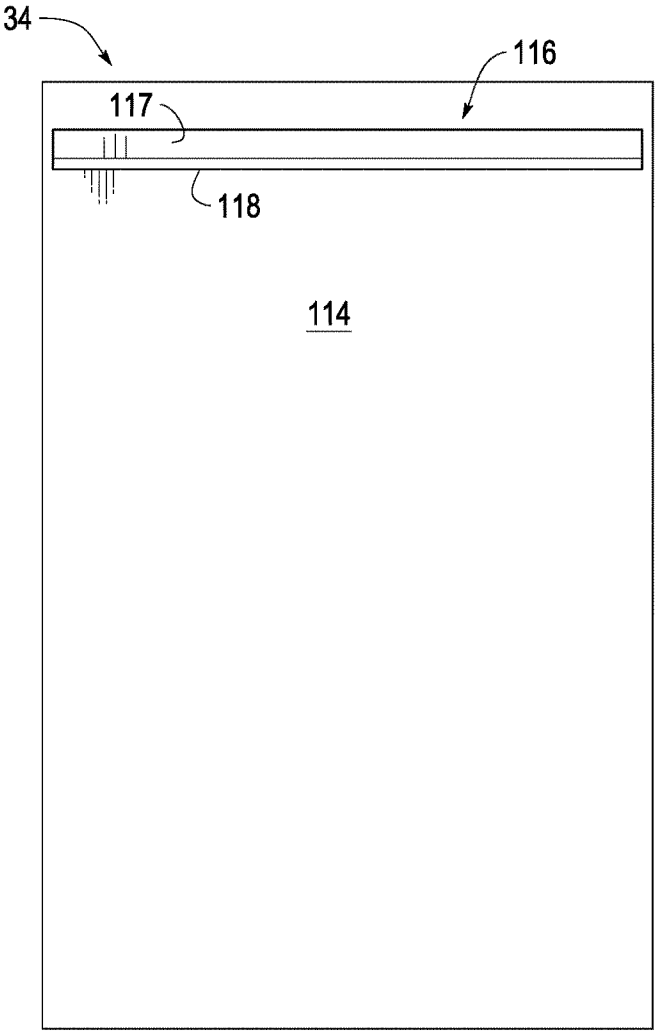
FIG. 25 is an interior elevation view of the second side wall assembly illustrated in FIGS. 23 and 24.

As stated, flange 145 of vertical edge angle 140 of back wall assembly 36 includes a series of spaced holes 148 and flange 146 of vertical edge angle 141 of back wall assembly 36 includes a series of spaced holes 149, as shown in FIGS. 24 and 24A.

Vertical edge tube 98A of second side wall assembly 34 has a series of holes 138 that match holes 148 in flange 145 of vertical edge angle 140, as shown in FIG. 21. Vertical edge tube 93A of first side wall assembly 32 has a series of spaced holes 136 that match holes 149 in flange 146 of vertical edge angle 141, as shown in FIG. 17. Bolts or other fasteners are inserted through holes 138 and 148 to attach back wall assembly 36 and second side wall assembly 34, and bolts or other fasteners are inserted through holes 136 and 149 to attach back wall assembly 36 and first side wall assembly 32.

Figure 32:
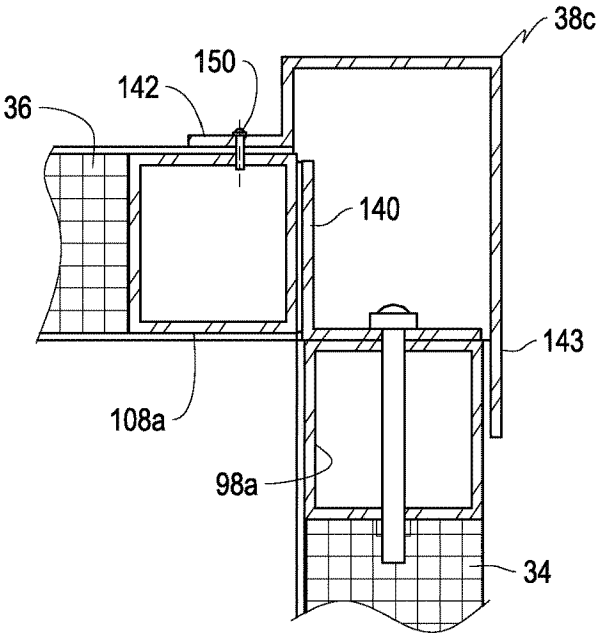
FIG. 32 is a top plan view of a back corner assembly of the secure video visitation booth illustrated in FIGS. 1-5.

Back corner closure plate 38C is attached to second side wall assembly 34 and back wall assembly 36 as follows. As shown in FIG. 32, back corner closure plate 38C has flanges 142 and 143. Flange 142 is attached to vertical tube 108A of back wall assembly 36 by mechanical fastener 150. Flange 143 may or may not be affixed to vertical tube 98*a* of second side wall assembly 34.

Back cover closure plate 38D is attached to first side wall assembly 32 and back wall assembly 36 in the same manner.

Ceiling panel 28 is attached to second flange 80 of interior angle 78 of front wall assembly 30, second flange 96 of interior angle 94 of first side wall assembly 32, second flange 107 of interior angle 104 of second side wall assembly 34 and second flange 118 of interior angle 116 of back wall assembly 37 by bolts, other types of mechanical fasteners or welding.

Bench 26 provides seating in secure video visitation booth 20. Bench 26 can be attached to first side wall assembly 32 and/or to floor assembly 24.

In this embodiment of the invention, bench 26 is along first side wall assembly 32 and A/V communications module 106 is embedded in second side wall assembly 34, so that a person sitting on bench 26 is facing video monitor 109 attached to A/V communications module 106.

Bench 26, video monitor 109, window frame assembly 66 of front wall assembly 30 and window frame assemblies 86A and 86B of first side wall assembly 32 are positioned relative to each other such that a person or persons on bench 26 are readily observable through window frame assemblies 66, 86A and 86B and video monitor 109 is readily observable through window frame assemblies 86A and 86B.

Alternatively, a movable bench or other seating support can be utilized in secure video visitation booth 20 such that the bench or other seating support can be moved within secure video visitation booth 20 as desired.

Door 27 is rotatably attached to door frame assembly 68 and can be locked in the locked position from outside to secure video visitation booth 20.

Figure 27:
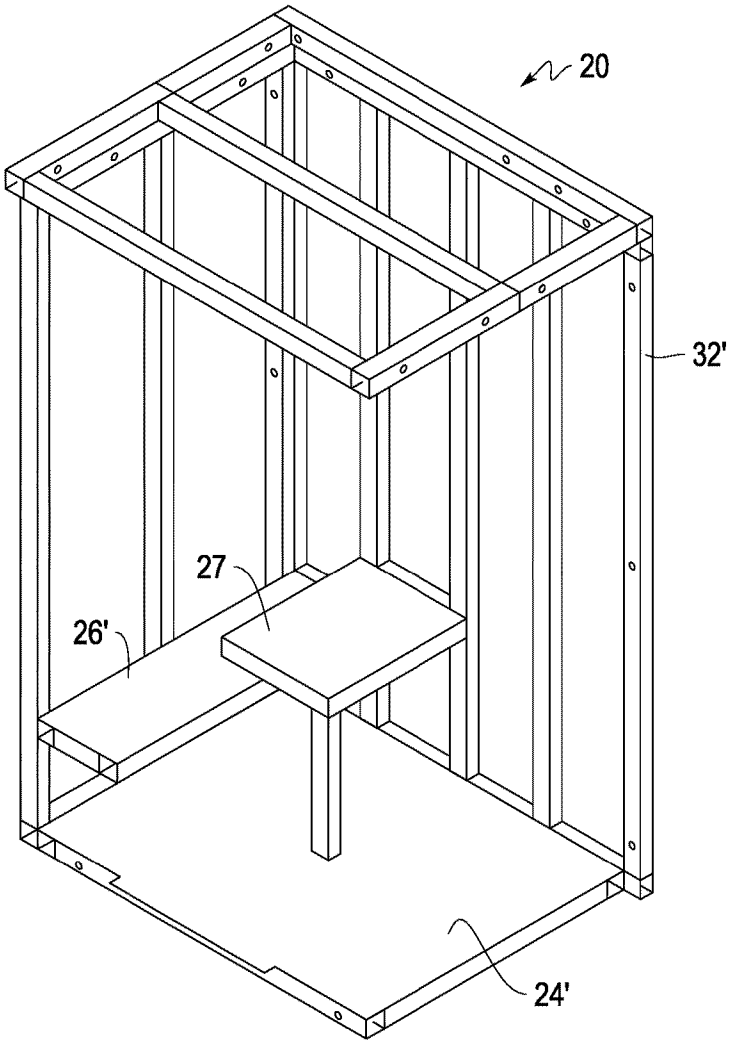
FIG. 27 is a partial top perspective view of a secure video visitation booth of another embodiment of this invention.

The secure video visitation booths of some embodiments of this invention may include a built-in or movable table, in addition to a bench. For example, in the embodiment illustrated in FIG. 27, secure video visitation booth 20', includes built in table 27 attached to floor assembly 24' and/or first side wall assembly 32', adjacent to bench 26'.

Figure 31:
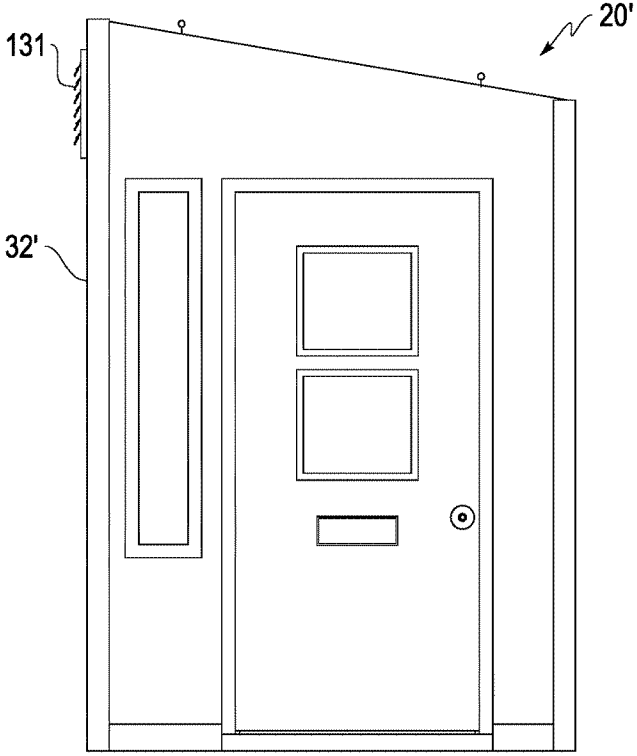
FIG. 31 is a front view of a secure video visitation booth of another embodiment of the invention with a ventilation fan in a side wall assembly.

In the secure video visitation booths of other embodiments of this invention, a ventilation fan can be provided in one of the ceiling panels and front, side and back wall assemblies. In the embodiment of FIG. 31, ventilation fan 131 is in side wall assembly 32' of secure video visitation booth 20'.

Figure 29:
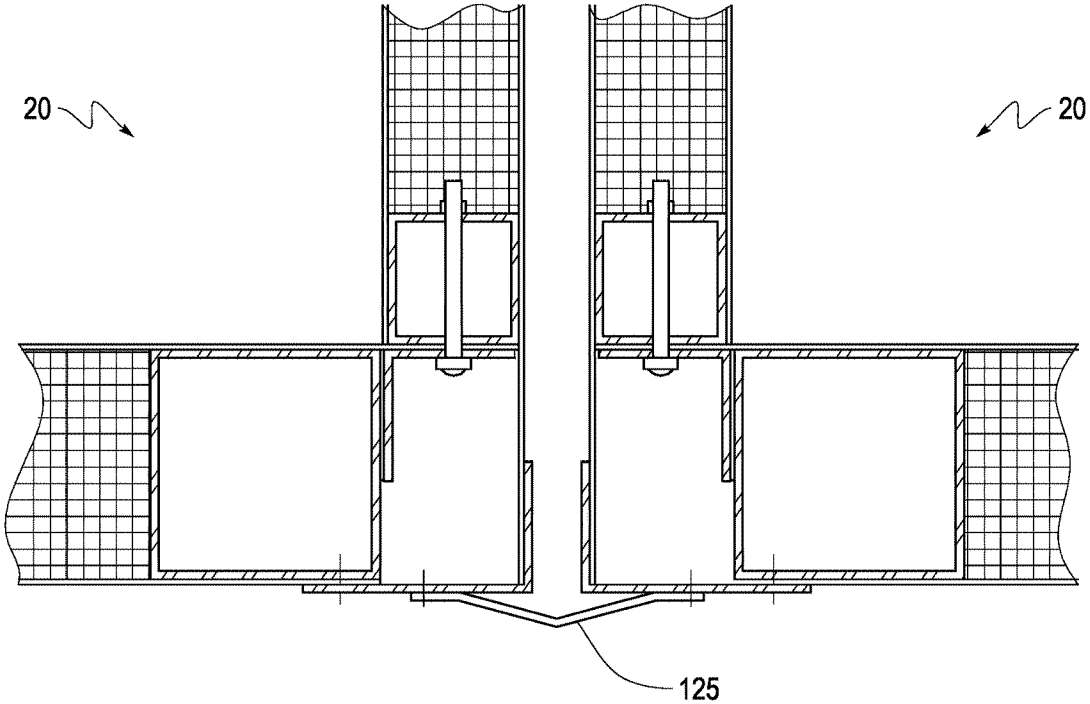
FIG. 29 is a partial top view of two secure video visitation booths of this invention connected by a plate.
Figure 33:
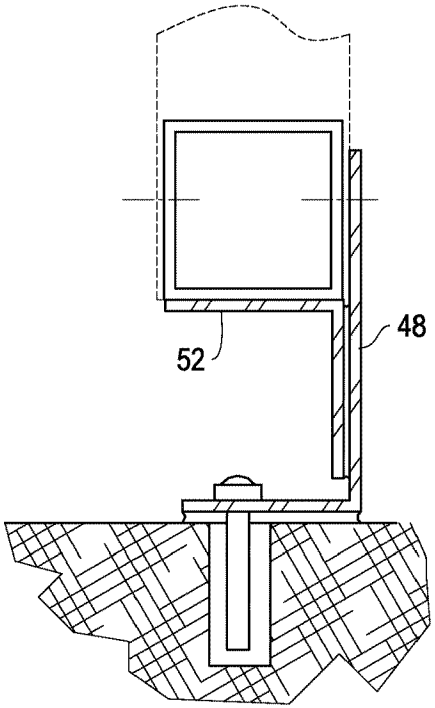
FIG. 33 is a partial side view of the connection of a wall assembly to the foundation assembly of the secure video visitation booth illustrated in FIGS. 1-5.

As stated, a plurality of the secure video visitation booths of this invention can be arranged in a room or other building space of a correctional facility. Adjacent booths can be joined together by a plate, such as plate 125 shown in FIG. 29.

In addition, as stated above, some of the embodiments of this invention do not include a foundation assembly or a floor assembly.

Figure 35:
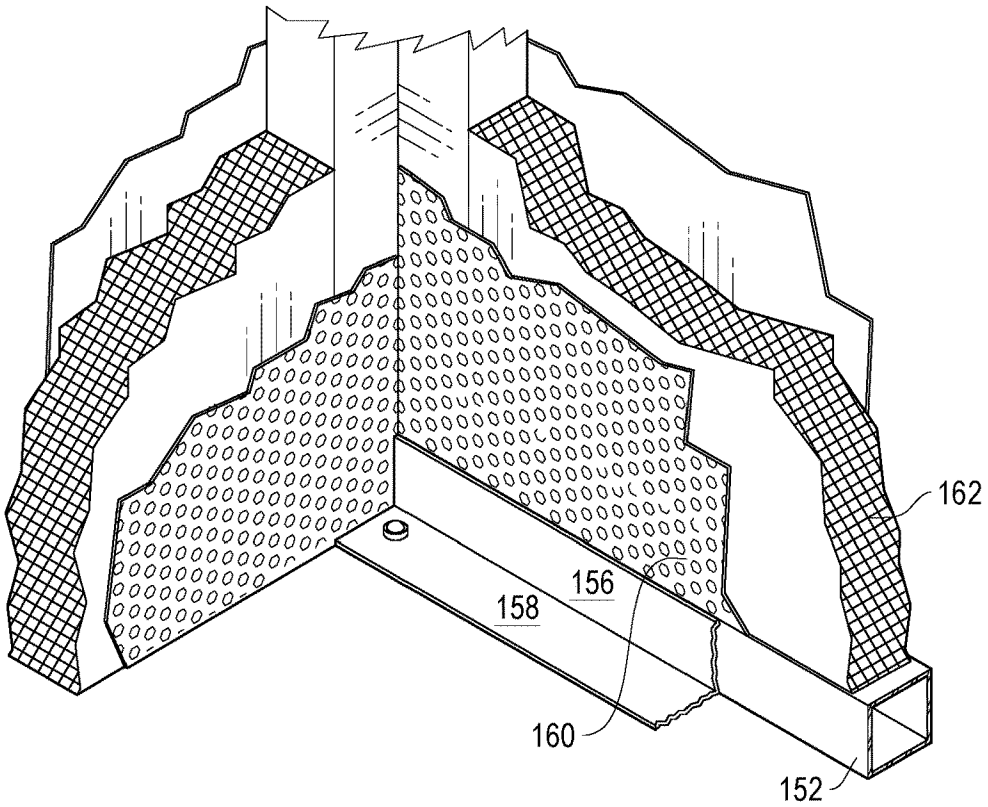
FIG. 35 is a side perspective view of the wall assembly and bracket illustrated in FIG. 34.

For example, as shown in FIGS. 34 and 35, one or more of front wall assembly 30, first side wall assembly 32, second sidewall assembly 34 and back wall assembly 36 may have tube 152 at its lower end (back wall assembly 36 is shown in FIG. 34). Angles 154, with upright leg 156 and horizontal leg 158, may be affixed to tube 152 by welding upright leg 156 to a face of tube 152. Horizontal leg 158 may have spaced holes to receive fasteners for fastening horizontal leg 158 to an existing floor.

What is described and illustrated herein are preferred embodiments of the invention and some variations of those embodiments. The description and figures are of examples of this invention, and are not intended as limitations on the invention. Those skilled in the art will recognize that there are other embodiments of this invention not specifically described above or illustrated in the figure, as defined by the following claims.

What is claimed is:

1. A secure video visitation booth comprising:

a plurality of wall assemblies including first, second, third and fourth wall assemblies joined at edges to form walls of the secure video visitation booth;

a ceiling panel supported by the plurality of wall assemblies and configured for air to pass through the ceiling panel;

a bench;

an A/V communication module in one of the plurality of wall assemblies;

a doorway that is a closure to the plurality of wall assemblies;

a door rotatably attached to the doorway and movable between open and closed positions; and first, second, third and fourth vertical edge members, wherein:

each of the plurality of wall assemblies includes a double wall construction with two spaced facing plates;

a first plate of the two spaced facing plates includes an exterior surface of the each of the plurality of wall assemblies;

a second plate of the two spaced facing plates includes an interior surface of the each of the plurality of wall assemblies;

at least one of the plurality of wall assemblies has a sound masking or sound cancellation capability;

each of the plurality of wall assemblies includes a set of spaced and parallel vertical tubes and a horizontal member attached to a top end of each of the spaced vertical tubes;

the two spaced facing plates are attached to the set of spaced and parallel vertical tubes and the horizontal member;

each set of spaced vertical tubes includes a first edge vertical tube and a second edge vertical tube at opposite vertical edges of the each of the plurality of wall assemblies;

each of the first wall assembly and the second wall assembly includes a first vertical angle attached to the first edge vertical tube and a second vertical angle attached to the second edge vertical tube;

a first flange of the first vertical angle is parallel and affixed to a first face of the first edge vertical tube and a second flange of the first vertical angle extends outwardly opposite the first face;

a third flange of the second vertical angle is parallel and affixed to a second face of the second edge vertical tube and a fourth flange of the second vertical angle extends outwardly opposite the second face;

the second and fourth flanges are attached to one of the first edge vertical tube and the second edge vertical tube of one of the third wall assembly and the fourth wall assembly;

one of the first, second, third and fourth vertical edge members is attached to each junction between the first wall assembly, the second wall assembly, the third wall assembly and the fourth wall assembly and covers the each junction; and the plurality of wall assemblies and the ceiling panel are sized and configured for individual use.

2. A secure video visitation booth according to claim 1, wherein the ceiling panel includes areas of a mesh material.

3. A secure video visitation booth according to claim 1, further comprising a table inside the booth.

4. A secure video visitation booth according to claim 1, further comprising:

a foundation and floor assembly configured to be placed on and supported by an existing floor and to include a floor surface of the secure video visitation booth; wherein:

the foundation and floor assembly includes a foundation assembly that includes members comprised of first and second foundation angles;

a first wall of the first foundation angle abuts and is connected to a first wall of the second foundation angle face-to-face;

a second wall of the first foundation angle and a second wall of the second foundation angle are spaced and parallel; and a floor assembly of the foundation and floor assembly is received and retained between the second wall of the first foundation angle and the second wall of the second foundation angle.

5. A second video visitation booth of claim 1, wherein a second of the plurality of wall assemblies includes a window.

6. An area of a correctional facility comprising a plurality of the secure video visitation booth according to claim 1;

wherein the plurality of secure video visitation booths are arranged such that persons inside each of the plurality of secure video visitation booths can be viewed from a common observation point.

* * * * *